US006724901B1

(12) United States Patent
Preuthun

(10) Patent No.: US 6,724,901 B1
(45) Date of Patent: Apr. 20, 2004

(54) HEARING AID AND SWITCH FOR A HEARING AID

(75) Inventor: Jan Harald Preuthun, Hellerup (DK)

(73) Assignee: Oticon A/S, Hellerup (DK)

( * ) Notice: Subject to any disclaimer, the term of this patent is extended or adjusted under 35 U.S.C. 154(b) by 0 days.

(21) Appl. No.: 09/806,999

(22) PCT Filed: Oct. 7, 1999

(86) PCT No.: PCT/DK99/00534

§ 371 (c)(1),
(2), (4) Date: May 18, 2001

(87) PCT Pub. No.: WO00/21335

PCT Pub. Date: Apr. 13, 2000

(30) Foreign Application Priority Data

Oct. 7, 1998 (DK) ..... 1998 01269

(51) Int. Cl.[7] ..... H04R 25/00
(52) U.S. Cl. ..... 381/324; 381/384
(58) Field of Search ..... 381/312, 322, 381/323, 324, 328, 370, 384; 181/129, 130, 135; 29/896.21

(56) References Cited

U.S. PATENT DOCUMENTS 4,739,512 A * 4/1988 Hartl et al. ..... 381/324
5,193,116 A * 3/1993 Mostardo ..... 381/324
5,463,692 A 10/1995 Fackler
5,915,031 A * 6/1999 Hanright ..... 381/324

FOREIGN PATENT DOCUMENTS

DE 4331382 11/1994
WO 95/12207 5/1995

* cited by examiner

*Primary Examiner*—Suhan Ni
(74) *Attorney, Agent, or Firm*—Dykema Gossett PLLC

(57) ABSTRACT

A switch device for a hearing aid includes first and second elements, the first element including a first portion for attachment to a circuit board and a second portion extending at an angle away from a side of the first portion, and the second element including a first portion for attachment to a circuit board, a second portion extending at an angle away from an end of the first portion, and a third portion extending at an angle away from a side of the first portion. The second portion of the second element is flexible and forms an arm which can be bent to create an electrical connection between the second portion of the first element and the third portion of the second element.

5 Claims, 4 Drawing Sheets

HEARING AID AND SWITCH FOR A HEARING AID

BACKGROUND OF THE INVENTION

A hearing aid comprising a housing having at least one acoustic inlet opening and at least one acoustic outlet opening, said housing containing at least one pickup means, an amplifier in connection with said pickup means, a receiver in connection with said amplifier and a switch for switching between different rationales for different listening conditions or between the mentioned pickup means and a further pickup means, said switch being operable from the housing exterior by means of an activating button.

In order to toggle between different programs or settings or different pickup means or a combination of these a switch may be provided in the housing. For the operation of the switch an activating button may be provided.

One previously known type of switch comprises mutually slidable parts. This previously known switch is rather complicated since it comprises several separate parts, which must be assembled prior to the mounting. This leads to a time consuming and therefore costly manufacturing of the hearing aid. Furthermore the previously known switches are rather space consuming in order to allow activating by the user. The large size is undesirable in connection with a hearing aid since this most often is desired to be as small as possible. This switch is also complicated both from a construction point of view and a assembling point of view.

The object of the present invention is to provide a hearing aid with a switch which is simpler from a construction point of view and which may be mounted in a simpler manner than hitherto known and at the same time occupies a small volume.

A further object of the invention is to provide a switch for use in a hearing aid which switch is simpler from a construction point of view and which may be mounted in a simpler manner than hitherto known.

A still further object of the invention is to provide a method for manufacturing a hearing aid as set forth in the foregoing.

SUMMARY OF THE INVENTION

According to the invention the object of the invention is achieved by means of a hearing aid of the type mentioned in the introductory part of the description characterized in comprising a switch which comprises a first and a second element adapted for mounting on a circuitry board, where the first element comprises a flexible arm adapted to be movable by means of the activating button in such a manner that the flexible arm hereby touches the second element.

By providing a hearing aid having the switching means provided in the above-mentioned manner a simple and reliable construction has been obtained. The hearing aid being provided with such switching means is simpler from a manufacturing point of view as well as a assembling point of view. The switch occupies only a very small volume.

In a preferred embodiment the arm is provided as a result of a bending of a part of the first element.

In a further preferred embodiment the second element comprises an area protruding from the circuitry board, preferably provided as a result of a bending of the second element. This is intended as a contact area for the flexible arm hereby allowing a larger tolerance of the bending between the first element and the flexible arm and furthermore allowing a larger tolerance of the movement of the flexible arm.

In a still further preferred embodiment the first element comprises an area supporting the flexible arm when this is activated by means of the activating button, said supporting area preferably being provided as a result of a bending of a part of the first element. This feature serves to control the movement of the flexible arm upon activating this towards the second element.

According to the invention the switch is characterized in that it is manufactured as a single unit adapted for being separated in order to form a first element and a second element with a flexible arm.

By manufacturing the switch as a single unit adapted for subsequent separation it is possible to mount the switch as a unit element and after the mounting process perform a separation of the single unit into two mutually separated elements in order to provide electrically separated parts of the switch. Hereby the mounting is significantly facilitated.

In a preferred embodiment the single unit comprises two bendings, the area between the two bendings forming the first and the second elementt for connection of the switch to the circuitry board.

This embodiment is particularly suitable for surface mounting, a so-called SMT device.

In a preferred embodiment an end area of the single unit is adapted for separation, preferably a connection at one side of a bending. Having separated the first and the second element by a single cut or by cutting at two distanced positions the first and the second element are electrically separated.

This embodiment is specifically suitable for use in a hearing aid since only limited space is available and the switch for this reason must be limited in size. By this embodiment it is still possible to perform the separation in a reliable manner even on a switch of a very small size.

According to the invention the method is characterized in that, the single unit is mounted on a circuitry board, and the single unit is separated into two electrically isolated separate elements.

The invention will be described more detailed in the following description showing a preferred embodiment of a hearing aid according to the invention and where

DESCRIPTION OF THE PREFERRED EMBODIMENT

Figure 1:
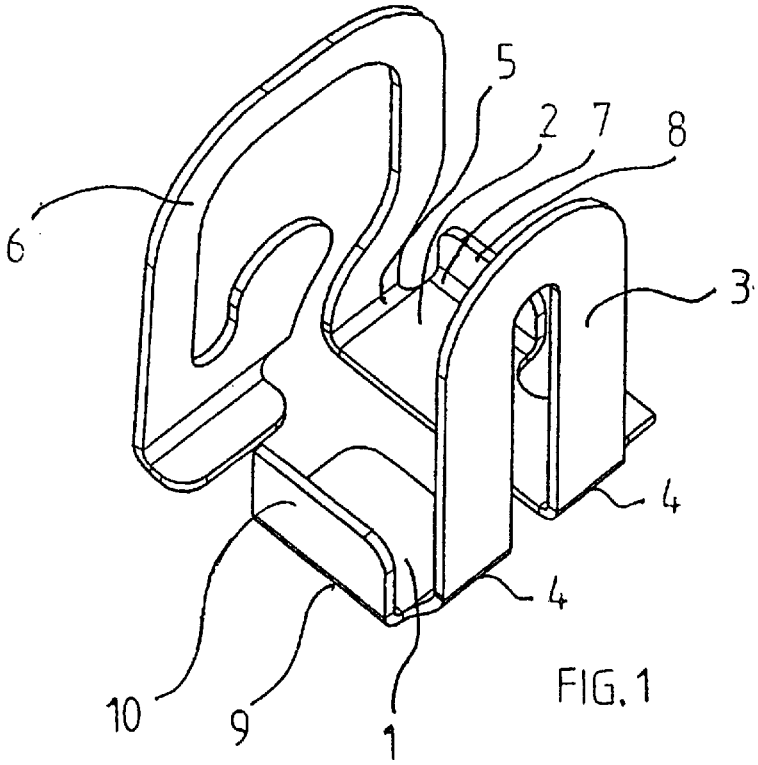
FIG. 1 is a perspective view of a switch according to the invention.

From FIG. 1 a switch contact appears, which comprises a first element 1 and a second element 2 forming the connection areas of the switch on a circuitry board. The two elements are interconnected by means of a connection 3 provided at a bending 4 at one side of the first and the second element. At the opposite side of the first element a further bending 5 is provided, which forms the borderline to a flexible arm 6. At a side perpendicular to the bending 5 the first element comprises a further bending 7 delimiting a support flap 8 for supporting the flexible arm 6 upon activating this at its outer end. At a side perpendicular to the bending 4 the second element comprises a further bending 9 delimiting a contact area 10.

Figure 2:
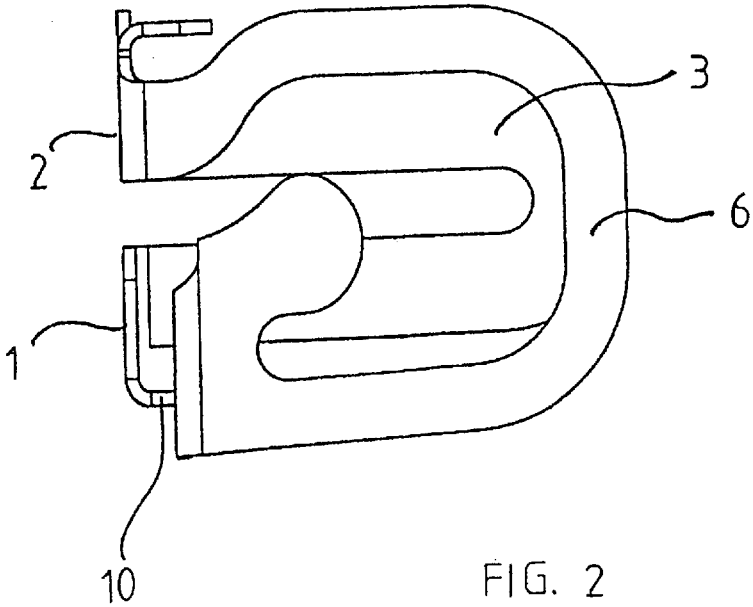
FIG. 2 is a side view of the switch shown in FIG. 1.

From FIG. 2 the flexible arm 6 appears more clearly. The arm may be provided with an impression for guiding the activating button.

Figure 3:
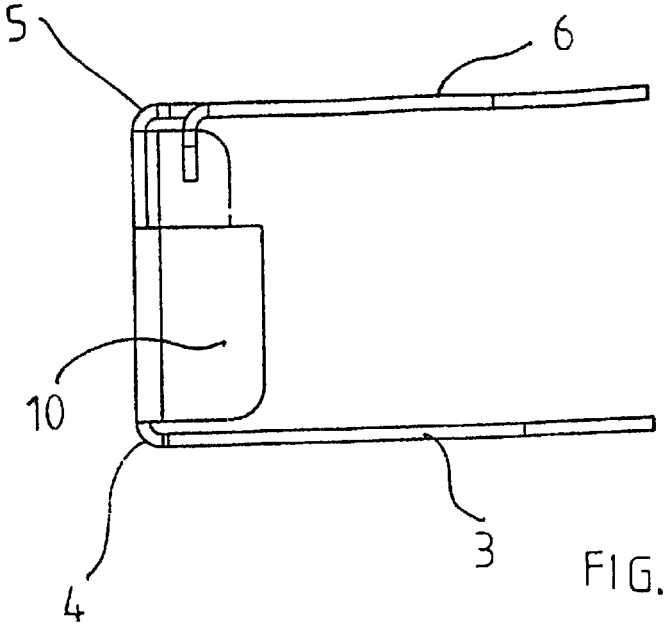
FIG. 3 is a top view of the switch shown in FIG. 1 and FIG. 2.

From FIG. 3 the connecting element 3 appears as well as the contact area 10.

Figure 4:
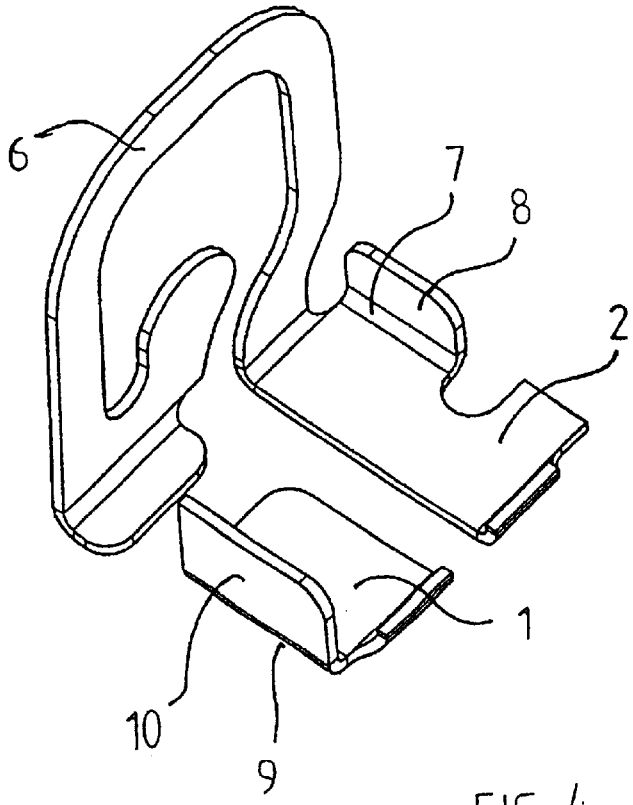
FIG. 4 is a perspective view where the first element and the second element have been separated.

From FIG. 4 it appears that the first element 1 and the second element 2 have been separated by cutting the connection element 3 at two positions close to the bending 4. Having cut the connecting element the first element and the second element are electrically separated. Activating the flexible arm 6 by pushing this to a contact with the contact element 10 will close or break a circuit and thereby give rise to a change of the conditions in a hearing aid in which the switch is mounted. This may e.g. be a hearing aid as shown in FIG. 5.

Figure 5:
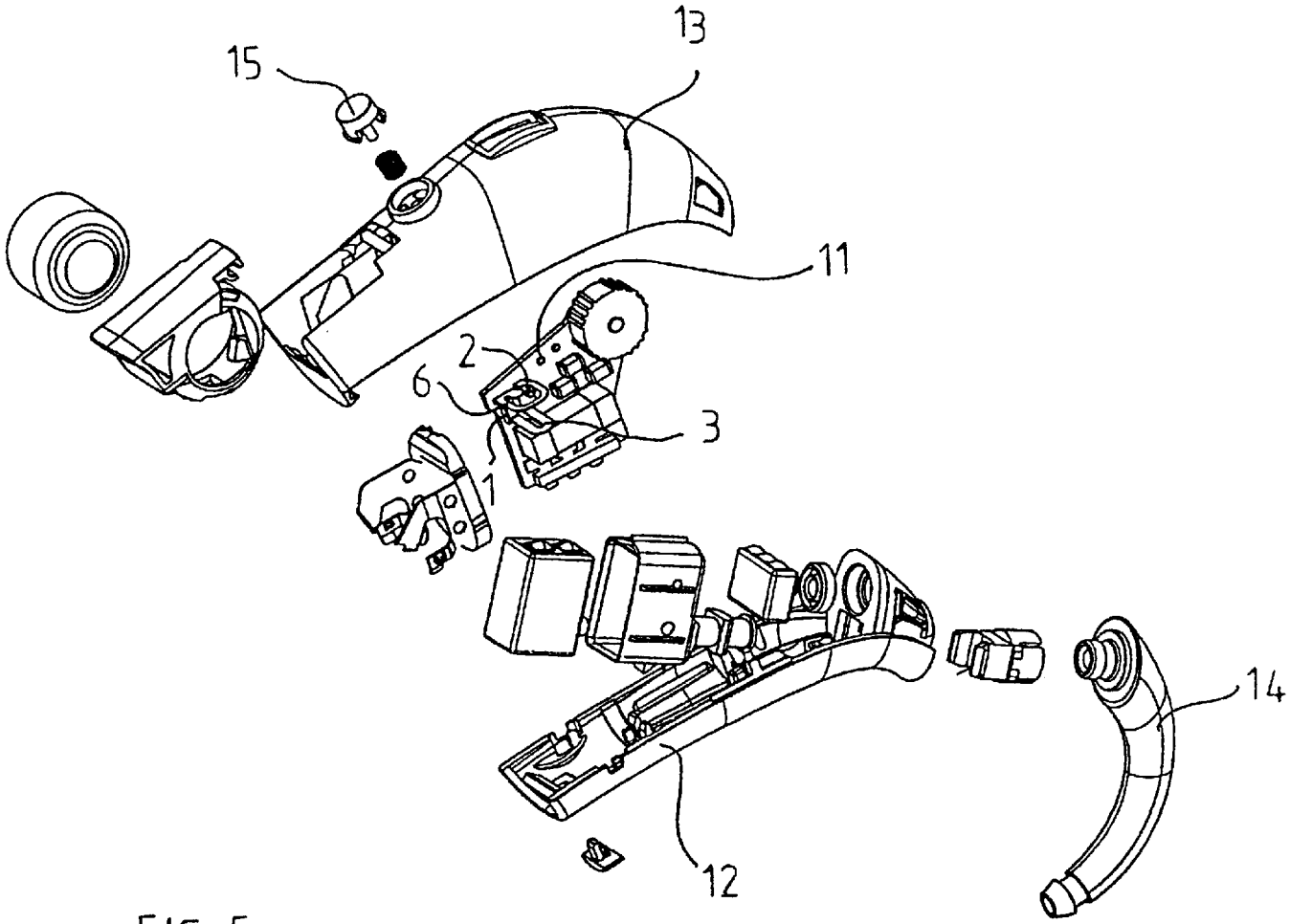
FIG. 5 is an exploded view of a hearing aid showing the switch of FIGS. 1–3 mounted on a circuitry board.

From FIG. 5 an exploded view of a hearing aid appears. The hearing aid comprises a housing divided into two shell parts, a first shell part 12 and a second shell part 13. At the upper end of the housing a hook 14 is mounted in an adapter part. In the first shell part holding means are provided for receiving and holding the circuitry board 11 which on its side holds the amplifier, a volume control, a telecoil, programming terminals and the switch 1,2,3,6. The switch has in the shown embodiment not yet been separated. The holding means for the circuitry board comprise holding slots for the end areas of the board. This means that the board is fixed in transversal as well as longitudinal translation and may only be inserted and removed in a direction normal to the slot sides. The switch is activated by means of the activating button 15 mounted in the second shell part 13.

Figure 6:
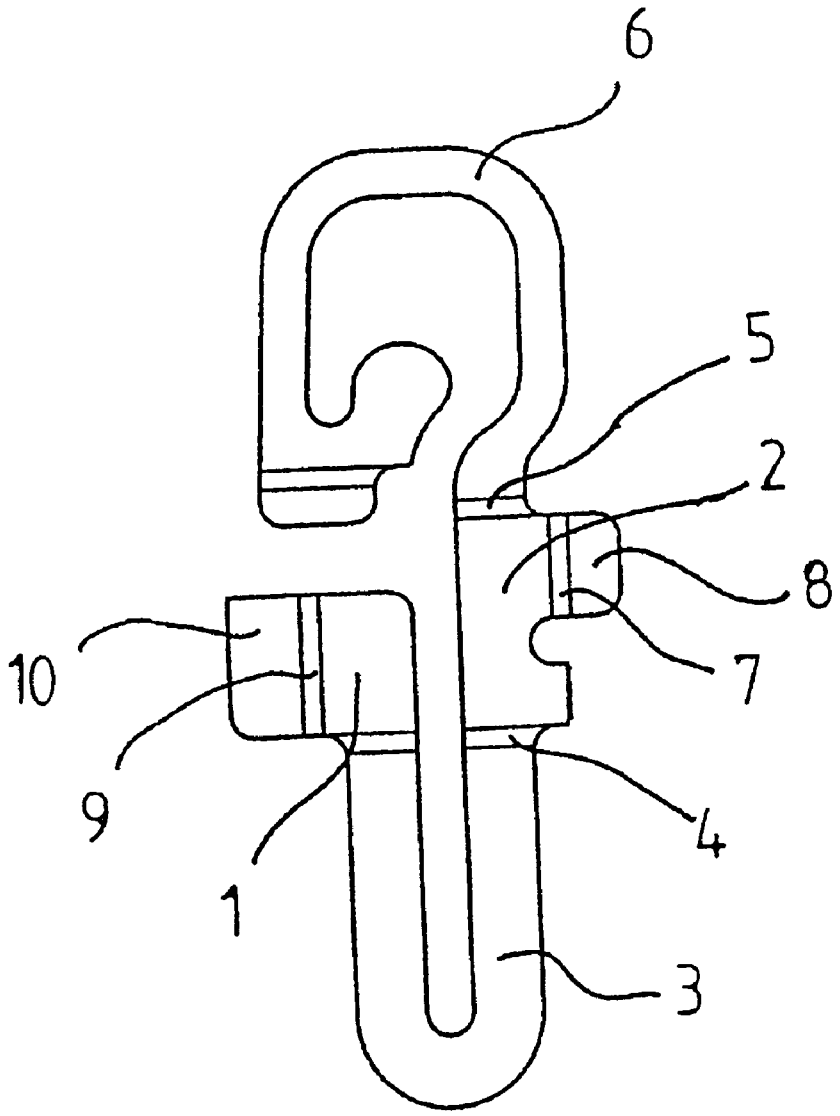
FIG. 6 is a top view of a punched planar element prior to a bending process for forming the switch of FIG. 1.

From FIG. 6 a planar element appears, which has been formed by a punching process. The planar element is subsequently submitted to a bending process in order to provide the switch as described in connection with the previous FIGS. 1–5.

What is claimed is:

1. A switch device for use in a hearing aid, said switch device comprising a first element which has a first flat portion that is attachable to a circuit board, and a second element which has a first flat portion that is attachable to a circuit board and a second portion which extends at an angle from a first end of said first flat portion of said second element, said second portion of said second element defining a flexible arm, wherein said second portion of said second element is flat and extends at a right angle to said first portion of said second element and including a connection element which connects a second end of said first element with a second end of said first portion of said second element.

2. A switch device according to claim 1, wherein said connection element is U-shaped.

3. A switch device according to claim 1, wherein said first element includes a second portion which is connected to a side of said first portion and which extends at a right angle relative to said first portion.

4. A switch device according to claim 3, wherein said second element includes a third portion connected to a side of said first portion thereof, said third portion extending at a right angle relative to said first portion.

5. A switch device according to claim 4, wherein said second portion of said second element is bendable to contact said second portion of said first element and said third portion of said second element to provide electrical connection therebetween.

* * * * *